US011618071B2

(12) United States Patent
Rollinger et al.

(10) Patent No.: US 11,618,071 B2
(45) Date of Patent: Apr. 4, 2023

(54) CORE FOR METAL CASTING AN AERONAUTICAL PART

(71) Applicant: SAFRAN, Paris (FR)

(72) Inventors: Adrien Bernard Vincent Rollinger, Moissy-Cramayel (FR); Ramzi Bohli, Moissy-Cramayel (FR); Ngadia Taha Niane, Moissy-Cramayel (FR); Alain Armel Le Hegarat, Moissy-Cramayel (FR); Romain Pierre Cariou, Moissy-Cramayel (FR); David Grange, Moissy-Cramayel (FR); Didier Maurice Marceau Guerche, Moissy-Cramayel (FR)

(73) Assignee: SAFRAN, Paris (FR)

( * ) Notice: Subject to any disclaimer, the term of this patent is extended or adjusted under 35 U.S.C. 154(b) by 0 days.

(21) Appl. No.: 17/046,592

(22) PCT Filed: Apr. 12, 2019

(86) PCT No.: PCT/FR2019/050874
§ 371 (c)(1),
(2) Date: Oct. 9, 2020

(87) PCT Pub. No.: WO2019/197791
PCT Pub. Date: Oct. 17, 2019

(65) Prior Publication Data

US 2021/0138533 A1 May 13, 2021

(30) Foreign Application Priority Data

Apr. 13, 2018 (FR) ..... 1853268

(51) Int. Cl.
*B22C 9/10* (2006.01)
*B22C 9/24* (2006.01)
(Continued)

(52) U.S. Cl.
CPC ..... *B22C 9/103* (2013.01); *B22C 9/04* (2013.01); *B22C 9/24* (2013.01); *F01D 5/187* (2013.01); *F05D 2230/21* (2013.01)

(58) Field of Classification Search
CPC ..... B22C 9/10; B22C 9/103; B22D 25/02
See application file for complete search history.

(56) References Cited

U.S. PATENT DOCUMENTS

2003/0075300 A1* 4/2003 Shah ..... B22C 21/14 164/369
2008/0164001 A1 7/2008 Morris et al.
(Continued)

FOREIGN PATENT DOCUMENTS

EP 3002070 A1 4/2016
RU 2094163 C1 10/1997
(Continued)

OTHER PUBLICATIONS

Official Communication dated Nov. 14, 2018, in FR Application No. 1853268 (2 pages).
(Continued)

*Primary Examiner* — Kevin E Yoon
(74) *Attorney, Agent, or Firm* — Bookoff McAndrews, PLLC

(57) ABSTRACT

A core for the foundry of an aeronautical part such as a turbine blade, the core being intended to be disposed in an inner housing defined by a mold, the core comprising a body intended to form the internal shape of the turbine blade, an impact portion, disposed on at least a portion of the periphery of the body so as to break a fluid jet when filling the inner housing with the fluid, the impact portion comprising a top and at least one deflection wall converging towards the top.

16 Claims, 4 Drawing Sheets

(51) Int. Cl.
*B22C 9/04* (2006.01)
*F01D 5/18* (2006.01)

(56) References Cited

U.S. PATENT DOCUMENTS

| | | | | |
|---|---|---|---|---|
| 2013/0323078 | A1 | 12/2013 | Beattie et al. | |
| 2017/0335706 | A1 | 11/2017 | Davis et al. | |
| 2018/0161866 | A1* | 6/2018 | Deines | B22C 9/10 |

FOREIGN PATENT DOCUMENTS

| | | | |
|---|---|---|---|
| RU | 2008114147 | A | 10/2009 |
| RU | 2461439 | C2 | 9/2012 |

OTHER PUBLICATIONS

International Search Report issued in International Application No. PCT/FR2019/050874 dated Aug. 28, 2019, with English translation (5 pages).
Russian Office Action issued in Russian Application No. 2020137214 dated Dec. 29, 2021 (7 pages).
Russian Search Report issued in Russian Application No. 2020137214, search completed Dec. 6, 2021 (2 pages).

* cited by examiner

CORE FOR METAL CASTING AN AERONAUTICAL PART

CROSS-REFERENCE TO RELATED APPLICATIONS

This application is the U.S. national phase entry under 35 U.S.C. § 371 of International Application No. PCT/FR2019/050874, filed on Apr. 12, 2019, which claims priority to French Patent Application No. 1853268, filed on Apr. 13, 2018.

FIELD OF THE INVENTION

The present disclosure relates to the field of manufacturing, by lost-pattern foundry for the directional solidification, aeronautical parts such as turbine blades. More particularly, the present disclosure relates to a core for the manufacture of an aeronautical part. The invention further relates to a molding device comprising said core, as well as a method for producing said core.

TECHNOLOGICAL BACKGROUND

Foundry processes called lost-wax or lost-pattern foundry processes are particularly suitable for the production of metal parts with complex shapes, for example hollow metal parts. Thus, the lost-pattern foundry is used in particular for the production of turbomachine blades.

In the lost-pattern foundry, the first step is the production of a pattern made of removable material with a comparatively low melting temperature, such as a wax or a resin, on which a mold is then overmolded. After consolidation of the mold, the removable material is discharged from the interior of the mold.

In order to be able to produce several parts simultaneously, it is possible to combine several patterns made of removable material in a single cluster, each pattern made of removable material being connected at least to one frame, generally a central or downward shaft, which is not made of removable material and a distribution ring made of removable material. The ring forms in the mold runners for the molten metal, also known as supply system.

A molten metal is then cast in this mold, in order to fill the cavity formed by the pattern in the mold after its discharge. Once the metal is cooled and completely solidified, the mold can be opened or destroyed in order to recover a metal part conforming to the shape of the pattern made of removable material.

It is meant by "metal" in the present context, both pure metals and metal alloys.

It is known from the prior art to insert a core in the mold for molding a part so as to obtain an aeronautical, hollow part. A mold comprising a core of the prior art is represented in FIG. 1. However, when a core is used for molding an aeronautical part, there is a lot of poor manufacture due to the displacement of the core during the injection of removable material or the casting of the metal. In addition, the use of a core implies strong section differences in the metal once cast, generating areas of high stresses during the cooling of the metal, in particular at the areas of transition between a thin section and a larger section of metal. When trying to produce a monocrystalline or columnar part, for example, these strong stresses during the cooling of the metal can cause dislocation movements, which can lead to recrystallization defects on the final aeronautical part.

PRESENTATION OF THE INVENTION

The present disclosure aims at overcoming all or part of the drawbacks mentioned above.

To this end, the present disclosure relates to a core for the foundry of an aeronautical part such as a turbine blade, the core being intended to be disposed in an inner housing defined by a mold, the core comprising:

a body intended to form the internal shape of the aeronautical part, an impact portion, disposed on at least a portion of the periphery of the body so as to break a fluid jet when filling the inner housing with the fluid, the impact portion comprising a base, a top and at least one deflection wall converging from the base to the top.

For example, the aeronautical part is a monocrystalline or columnar part.

It is meant by "fluid jet" the jet of molten metal which is intended to fill the mold, by casting, or the jet of removable material, for example wax, in the liquid state intended to fill the mold by injection. By cooling, the fluid solidifies and becomes material which will be then machined to obtain the final aeronautical metal part or its wax pattern.

For example, the fluid jet can arrive from above, that is to say substantially in the direction of gravity, or from below, that is to say in a direction opposite to the gravity. It is meant by "top" the part of the impact portion defining one end of the impact portion and, in most cases, defining one end of the core.

The top can be located at a point or can extend along a segment. For example, the segment is curved. Preferably, the top is one-dimensional.

It is meant by "base of the impact portion" the surface defined by the boundary between the body and the impact portion.

It is understood that at least part of the body constitutes the useful portion of the core, that is to say, the portion which will be used for the molding of the final part. At least part of the body therefore allows creating the cavities of the aeronautical part. At least part of the body therefore constitutes the negative of the cavities of the aeronautical part.

The impact portion, on the other hand, does not contribute to the definition of the geometry of the aeronautical part. The material that will be molded around the impact portion is a sacrificial portion that will be cut to obtain the aeronautical part.

Thanks to these dispositions, the fluid jet is broken, that is to say shattered or deflected, upon contact with the impact portion, which allows reducing the stresses exerted on the core when it is subject to the force of the fluid jet. This allows limiting the offset of the core and thus preserving the dimension and the positioning of the internal shape of the aeronautical part. This implies that the sensitive areas of the main portion of the core, for example the thinnest parts, are only slightly urged.

In addition, thanks to these dispositions, the temperature gradient in the solidifying material is controlled, thus making it possible to limit the thermo-mechanical stresses in the direction of solidification. If the temperature gradients are controlled and low, the stresses and plastic deformations in the metal are also controlled. The risks of recrystallized grains and cold cracks are greatly reduced.

In addition, in the case of metal casting, the high-stress area, disposed at the transition between a small section and a larger section, is moved at the impact portion and not at the level of at least part of the body constituting the useful portion of the core. Thus, the stresses resulting in the appearance of recrystallized grains are moved out of the portion of solidifying material intended to become the aeronautical part.

Finally, a smaller amount of fluid is necessary for the molding of the aeronautical part or its pattern made of removable material. In addition, the addition of the impact portion allows having more space to position foundry devices, such as points of support of the core in the mold, a heat shield or a dimensioning housing.

According to one aspect, the body is elongated and extends along a main direction. The impact portion is disposed as a continuation of the body along the main direction.

The body comprises solid first and second end portions connected by a plurality of arms, intended to form a plurality of cavities in the aeronautical part or in its pattern made of removable material.

According to one aspect, the impact portion is disposed as a continuation of the first end portion of the body. For example, the first end portion of the body is intended to form a tip for a turbine blade. It is meant by "tip" a hollow formed at one end portion of the core.

According to one aspect, the impact portion extends continuously from the body.

It is understood that at least one deflection wall extends as a continuation of a wall of the body. The boundary between the at least one deflection wall and the body wall is therefore smooth. In other words, the body wall and the at least one deflection wall do not form a shoulder, a rupture or a sharp edge.

Thanks to these dispositions, the transition between a small section of the solidifying material, that is to say in the area around the core, and a larger section, that is to say in an area of the molding device where the core does not extend, for example at the ends of the molding device, is gradual. Thus, the evolution of the stresses during the cooling between these two areas is also gradual. In addition, this transition from a small section to a larger section is moved towards the impact portion, and therefore out of the solidifying material intended to form the aeronautical part. Thus, the defects in the material due to the high stresses related to the transition between a small section of material and a larger section are moved into an area which will not be part of the aeronautical part.

In one aspect, the top is rounded.

It is understood that the top is derivable along all directions. In other words, the top is not sharp and does not have a sharp edge. For example, the top is the result of a radiating operation.

Thanks to these dispositions, the accumulation of stresses is avoided. However, in other embodiments, a top having a sharp edge could be envisaged.

According to one aspect, the slope of the at least one deflection wall in at least one plane normal to the base and passing through the top, preferably all planes normal to the base and passing through the top, has several values.

This allows a gentle evolution of the section of the material and thus allows limiting the stresses exerted by the solidifying part.

It is understood that at least one deflection wall has a curvature between the base and the top.

According to one aspect, the slope of the at least one deflection wall is lower in the vicinity of the top than the slope in the vicinity of a base of the impact portion. Thus, the impact portion has a tipless bulged shape that can form a singularity, which allows avoiding too high concentration of stresses.

It is understood that the impact portion thus forms a dome. In other words, the impact portion is bulged. The tangent to the at least one deflection wall on a base-to-top path tends towards a direction parallel to the base. In other words, the slope of the at least one deflection wall decreases towards the top.

According to one aspect, the impact portion has a height comprised between 100% and 1,000% of the width of the core, preferably between 150% and 300% of the width of the core. It is meant by "width of the core" its greatest measurement along a direction perpendicular to the main direction.

According to one aspect, the impact portion has a height comprised between 100% and 1,000% of the width of the tip, preferably between 150% and 300% of the width of the tip.

According to one aspect, the body and the impact portion are formed integrally.

Thus, the core is more robust and the risks that the impact portion detaches from the body of the core are limited.

According to one aspect, the core comprises a dimensioning housing arranged in the impact portion. The dimensioning housing allows measuring the withdrawal of the core and checking the correct sizing of the manufactured core.

According to one aspect, the impact portion and the body are connected at least by a plurality of shanks, for example made of alumina. The shanks allow creating dust-removal holes for the blade.

The present disclosure further relates to a molding device for a turbine blade, comprising:

- a mold defining an inner housing, the inner housing comprising a fluid inlet;
- a core conforming to any one of the aforementioned aspects, disposed inside the housing, the impact portion being disposed facing the fluid inlet.

Thanks to these dispositions, the jet during the injection of removable material or the casting of metal for the foundry of the aeronautical part is broken before reaching the useful portion of the core.

It is understood that the impact portion is directed towards the fluid inlet so that the fluid jet arrives onto the impact portion. In other words, the fluid jet does not necessarily arrive onto the top of the impact portion.

The inner housing defined by the mold also extends along the main direction of the core and comprises a first end area and a second end area. The first end area comprises the fluid inlet. The impact portion is disposed in the first end area.

The present disclosure also relates to a method for producing a core for the foundry of an aeronautical part such as a turbine blade, the core being intended to be disposed in an inner housing defined by a mold, the core comprising a body intended to form the internal shape of the aeronautical part, an impact portion, disposed on at least a portion of the periphery of the body so as to break a fluid jet when filling the inner housing with the fluid, the impact portion comprising a base, a top and at least one deflection wall converging from the base to the top, the method for producing the core comprising the following steps:

designing a core pattern comprising the provision of the body of the core and the generation of an impact portion, and manufacturing the core based on the pattern.

These dispositions allow obtaining the core described above. Accordingly, all of the aforementioned technical effects are applicable to the present method.

According to one aspect, the step of generating the impact portion comprises an extrusion sub-step consisting of forming a prism from the body, the prism extending from the base, and a sub-step of cutting the prism.

Thanks to these dispositions, the step of generating the impact portion is quick and easy.

According to one aspect, the cutting is carried out along a curved surface.

According to one aspect, the step of generating the impact portion further comprises a sub-step of radiating the sharp edges after the sub-step of cutting the prism.

The sub-step of radiating edges allows avoiding the presence of sharp edges.

According to one aspect, the step of generating the impact portion is carried out by Computer-Aided Design software.

The use of computer-aided design software makes it possible, thanks to the digital pattern, to generate a mold from the digital pattern and thus to manufacture the core by foundry or by additive manufacturing, for example.

For example, the step of generating the impact portion is carried out by a function of the Computer-Aided Design software, for example by the function called "multi-section surface" function, making it possible to create a surface passing through several curves.

BRIEF DESCRIPTION OF THE DRAWINGS

The object of the present disclosure and its advantages will be better understood upon reading the following detailed description of embodiments of the invention given by way of non-limiting examples. This description refers to the appended drawings, in which.

DETAILED DESCRIPTION OF THE INVENTION

Figure 1:
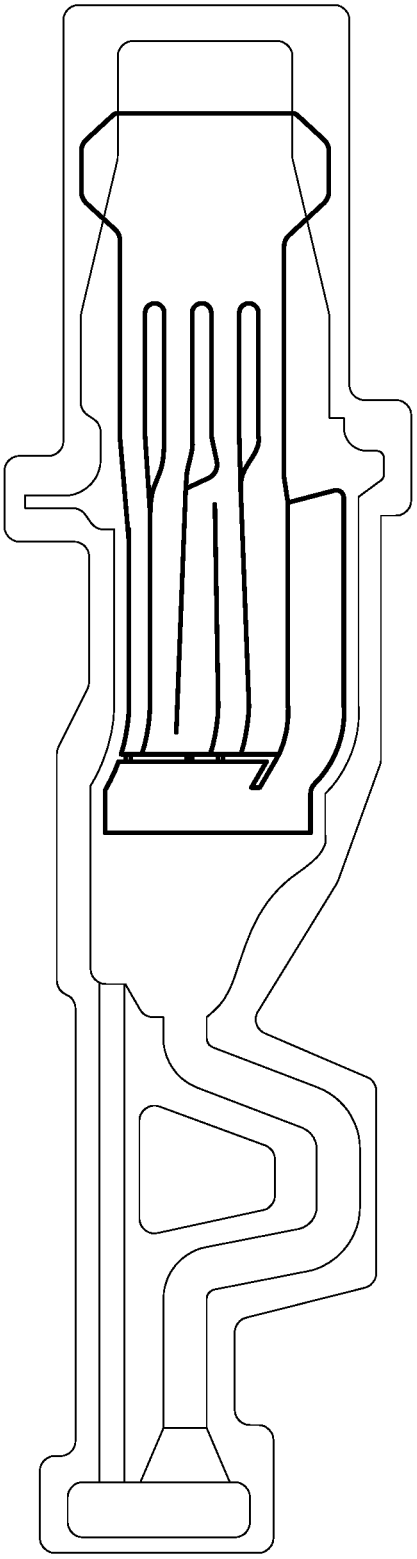
FIG. 1 represents a device for molding a turbine blade comprising a core of the prior art.
Figure 2:
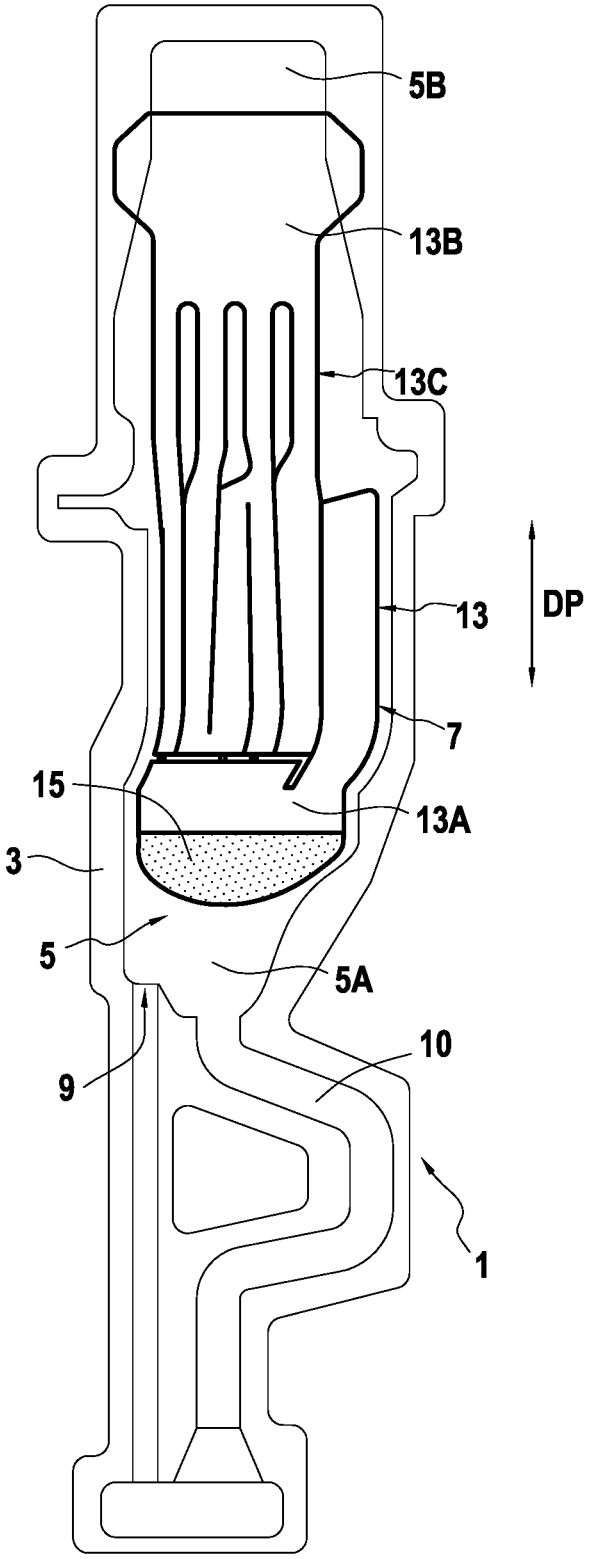
FIG. 2 represents a device for molding a turbine blade comprising the core according to the present disclosure.

FIG. 2 represents a molding device 1, suitable for the turbine blade foundry in this example. The molding device 1 comprises a mold, here a molding shell 3, defining an inner housing 5. Indeed, the exemplary embodiments represented in the figures relate more particularly to the casting of metal in a shell mold. The molding device 1 further comprises a core 7 disposed inside the inner housing 5.

Core 7 has an elongated shape and extends along a main direction DP. The inner housing 5 and therefore the molding shell 3, also have an elongated shape and extend along the same main direction DP. Thus, the inner housing 5 comprises a first end area 5A and a second end area 5B.

The inner housing 5 comprises a fluid inlet 9, allowing the casting of fluid in the molding device 1 so as to mold a turbine blade. The fluid inlet 9 opens onto the first end area 5A, substantially in the main direction DP.

For example, the core 7 is composed of a refractory material relative to the cast or injected fluid. For example, the core 7 is made of ceramic or metal with a high melting point that is to say with a melting point above 1,500° C.

Figure 3:
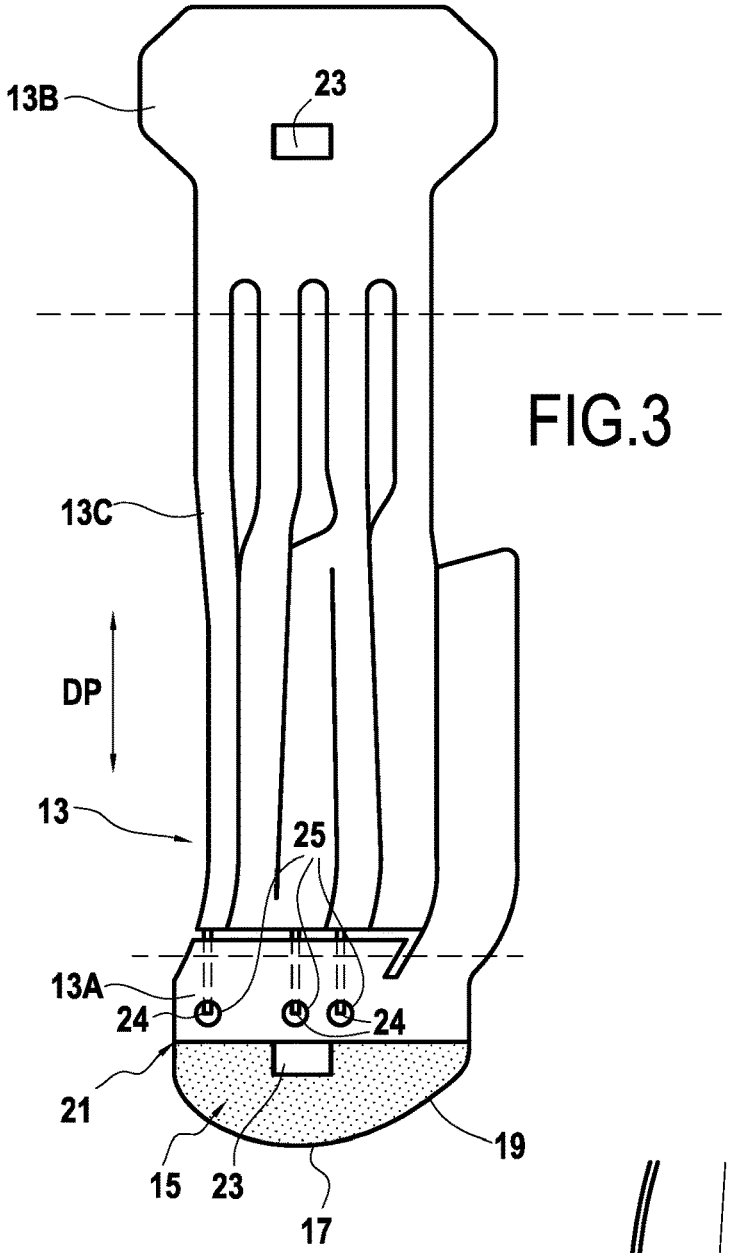
FIG. 3 represents a core according to the present disclosure.

The core 7, represented in more detail in FIG. 3, comprises a body 13, at least part of which is intended to form the internal shape of the turbine blade, in other words its inner cavities, that is to say the at least part of the body 13 constitutes the useful portion of the core 7. The body 13 has an elongated shape and extends along the main direction DP. The body 13 comprises a first end portion 13A, intended to form the tip of the turbine blade, and a second end portion 13B, intended to form the cavity of the turbine blade root. The first and second end portions form two blocks connected by a plurality of arms 13C. The arms 13C are intended to form the ventilation cavities of the blade.

The core 7 further comprises an impact portion 15, disposed on one side of the body 13. More specifically, the impact portion 15 is disposed as a continuation of the first end portion 13A of the body 13 along the main direction DP. In this example, the first end portion 13A of the body 13 is intended to form the tip of the turbine blade. Thus, the impact portion 15 is disposed facing the fluid inlet 9 so as to break a fluid jet upon casting the fluid in the molding device 1.

The impact portion 15 comprises a base 21, a top 17 and a deflection wall 19 converging from the base 21 to the top 17, the deflection wall 19 extending as a continuation of the wall of the body 13. In this example, as can be seen in FIG. 2, the top 17 is not disposed facing the fluid inlet 9. The fluid jet is therefore here broken by a lateral part of the impact portion 15.

In the present example, as can be seen in FIG. 2, the fluid jet arrives from the bottom of the molding device 1, that is to say the fluid jet arrives substantially in the opposite direction of the direction of gravity. In other words, the casting is carried out at the source. The first end area 5A is therefore disposed at the bottom of the inner housing 5 along the direction of gravity. However, in other exemplary embodiments, the fluid inlet 9 could be disposed at the top of the inner housing 5, that is to say the fluid jet is directed in the direction of gravity. In this case, the impact portion is disposed at the top of the molding device, facing the fluid inlet.

FIG. 2 also represents a baffle 10 which opens onto the first end area 5A. The baffle 10 serves as a grain selector, making it possible to direct the solidification of the final aeronautical part, which is monocrystalline or columnar. In the case of a source metal casting, the baffle can also serve as a metal supply system, that is to say the casting also takes place via the baffle 10.

Figure 4:
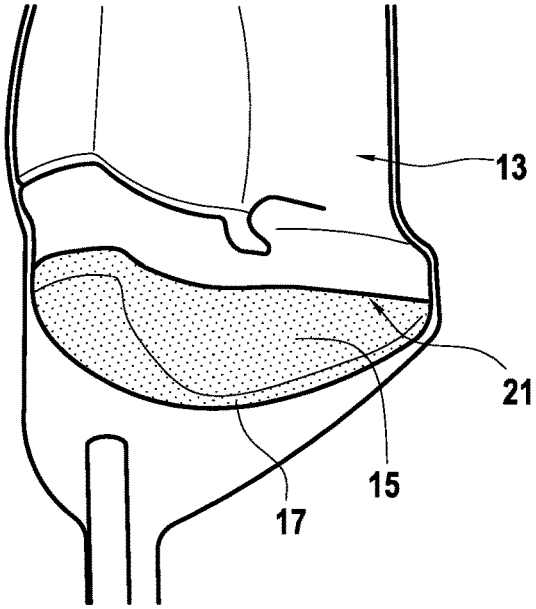
FIG. 4 represents a close-up view of the impact portion.

The top 17 has a rounded shape, in the exemplary embodiment represented, visible in FIGS. 3 and 4 for example. The height between the base 21 and the top 17 of the impact portion 15 along the main direction DP is approximately of 17 mm. The greatest width of the impact portion 15, at the top 17 is, for example, of about 6 mm.

According to all the planes normal to the base 21 and passing through the top 17, the slope of the deflection wall 19 has several values, decreasing as they approach the top 17. The impact portion 15 therefore has a substantially domed shape. The tangent to the deflection wall 19 in the vicinity of the base 21 is generally collinear with the main direction DP that is to say, in the represented example, generally vertical. While moving towards the top 17, the tangent to the deflection wall 19 tilts relative to the main direction. In the vicinity of the top 17, the tangent to the deflection wall 19 is generally perpendicular to the main direction DP, that is to say, in the represented example, generally horizontal.

FIG. 3 shows the useful portion of the core 1, between the dotted lines. It can be seen that the impact portion is located out of the useful portion of the core 7. It can also be seen that part of the second end portion 13B is located out of the useful portion of the core 7. Indeed, this part is engaged in elements for receiving the molding shell so as to hold the core 7 in position upon casting the fluid. These parts of the core 7 disposed out of the useful area allow simplifying the removal of the core from the final turbine blade. Indeed, when the material is solidified to form the turbine blade, there is more room for cutting the metal while also cutting part of the core 7. As a portion of the core 7 is cut, it is easier, after the chemical knock-out of the core 7, to remove dust from the molded turbine blade.

The core 7 comprises two dimensioning housings 23. One of the dimensioning housings 23 is arranged in the impact portion 15. The other of the dimensioning housings 23 is disposed in the second end portion 13B of the body 13. The dimensioning housings 23 allow checking the correct sizing of the core 7 during its manufacture. The dimensioning housings 23 are disposed out of the useful area.

As represented in FIG. 3, the core comprises shanks 24, for example made of alumina, further making it possible to create dust removal holes for the turbine blade. The first end portion 13A of the core 13 comprises holes 25 opening out onto the shanks 24 and thus giving access to the shanks 24 from the first end portion 13A.

Figure 5A:
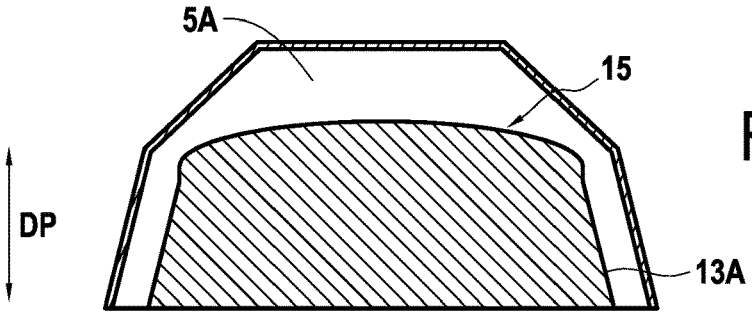
FIGS. 5A and 5B represent different embodiments of the impact portion.

The impact portion 15 and/or the first end portion 13A of the body 13 may be solid, as represented in FIG. 5A. However, the stresses on the core 7 during cooling of the material can be significant. The core could therefore break and the material could experience recrystallization defects.

Figure 5B:
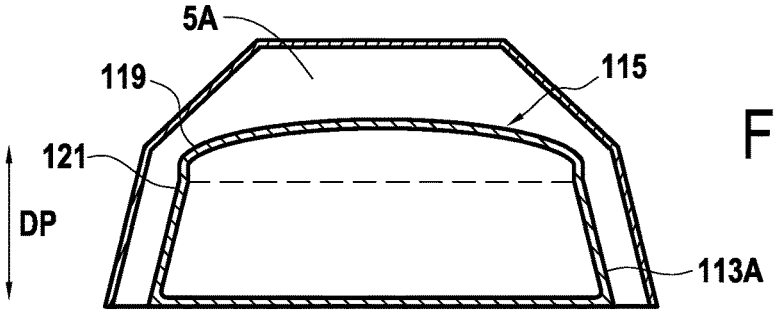

Thus, it is also possible to provide that the impact portion 115 and/or the first end portion 113A of the body 113 is/are hollow, as represented in FIG. 5B. Thus, upon cooling of the material, a portion of the deflection wall 119 close to the base 121 and/or the wall of the first end portion 113A of the body 113 may shatter and thus relieve the stresses in the solidifying material. The impact portion 115 and/or the first end portion 113A of the hollow body 113 may be produced by an additive process, for example by using inserts, removed during the firing of the core 7.

Figure 6:
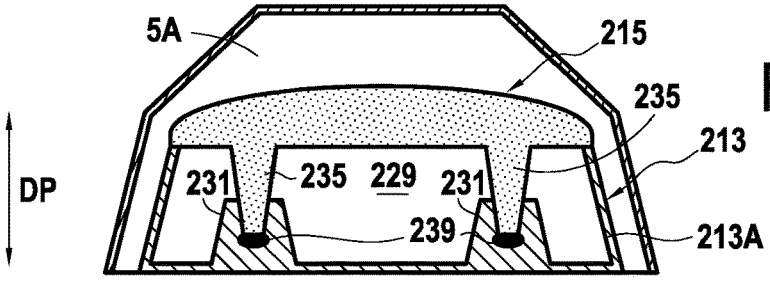
FIG. 6 represents an embodiment of the connection between the body and the impact portion.

The body 13 and the impact portion 15 can be formed integrally, in one piece, for example injected or produced by additive manufacturing together. The impact portion 215 can also be added onto the core 7 and fixed by any means, for example by welding, gluing, co-sintering or fitting. For example, as represented in FIG. 6, the first end portion 213A of the body 213 is hollow and forms a fixing space 229. The first end portion 213A of the core 213 comprises pads 231 extending along the main direction DP. The pads 231 each comprise a central cavity, also extending along the main direction DP. The impact portion 215 comprises rods 235 fixed to the base 21 and extending along the main direction DP. The rods 235 are configured to be inserted into the cavities of the pads 231. An adhesive point 239 is disposed at the bottom of each cavity and allows retaining the impact portion 215 on the body 213. This configuration allows trapping the glue such that it does not contaminate the material. In order to avoid stresses on the walls of the fixing space 229 due to an expansion of air in the fixing space 229 during the casting of fluid in the molding device, it is possible to put the fixing space 29 under vacuum.

Figure 7A:
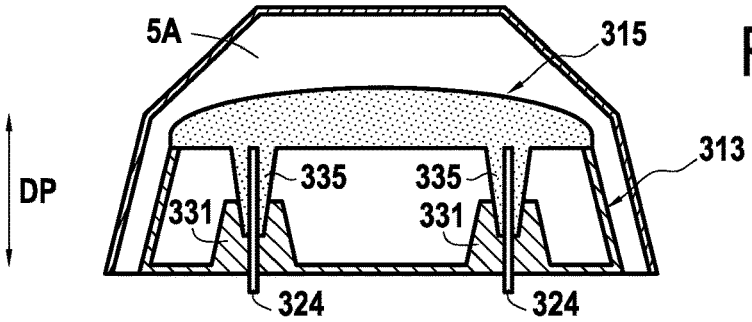
FIGS. 7A and 7B represent other embodiments of the connection between the body and the impact portion.

Alternatively, as represented in FIG. 7A, instead of being fixed by an adhesive point, the impact portion 315 and the body can be fixed by a plurality of the shanks 324. In this exemplary embodiment, the shanks 324 extend through each of the pads 331 and rods 335. In this example, the rods 335 are still inserted into the cavities of the pads 331.

Figure 7B:
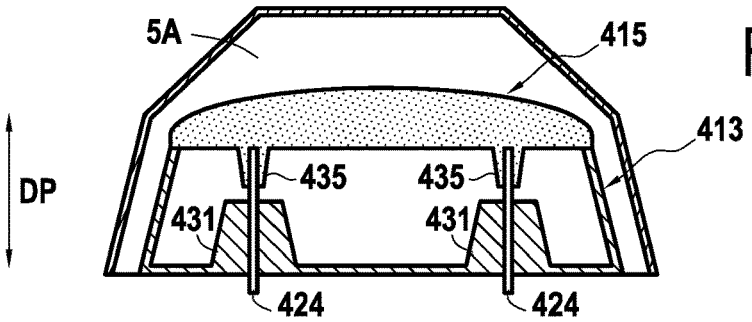

On the other hand, in a variant of this example represented in FIG. 7B, the pads 431 and the rods 435 do not cooperate and are connected only through the shanks 424. The roughness of the shanks 424 then ensures holding the impact portion 415 on the body 413.

The core 7 is made from a pattern which is then used for the actual manufacture of the core 7. The pattern is generally digital and produced by Computer-Aided Design (CAD). The design of this pattern will now be described with reference to FIGS. 8A, 8B and 8C.

Figure 8A:
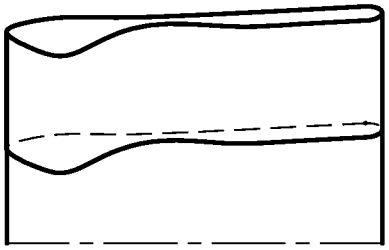
FIGS. 8A to 8C represent steps of producing the impact portion of the core.
Figure 8B:
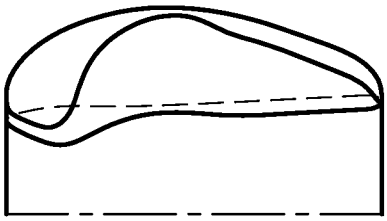

First, a prism is extruded from a core body pattern, which is provided. This prism is represented in FIG. 8A. The prism is extruded as a continuation of the wall of the core body pattern. Then, the prism is cut along a curve. The cut prism is represented in FIG. 8B.

Figure 8C:
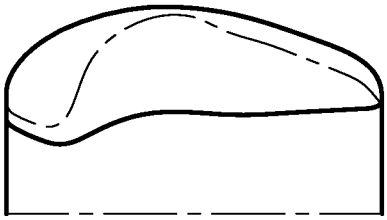

Then, the cut prism is radiated. The edges are radiated so as to obtain a dome shape, as represented in FIG. 8C, and thus form the impact portion pattern 15.

Then, when the pattern of the core, and therefore of its impact portion is designed, the step of manufacturing the core is carried out. The core is generally manufactured by injection from a mold. The body and the core can also be manufactured in two parts, from their respective pattern, and injected separately using molds.

Although the present invention has been described with reference to specific exemplary embodiments, modifications can be made to these examples without departing from the general scope of the invention as defined by the claims. Particularly, individual characteristics of the different illustrated/mentioned embodiments can be combined in additional embodiments. Consequently, the description and the drawings should be considered in an illustrative rather than a restrictive sense.

The invention claimed is:

1. A core for the foundry of an aeronautical part such as a turbine blade, the core being intended to be disposed in an inner housing defined by a mold, the core comprising:

a body intended to form the internal shape of the aeronautical part, wherein the body has a longest dimension extending along a longitudinal axis, an impact portion, intended to form a sacrificial portion that will be cut, disposed on at least a portion of the periphery of the body so as to break a fluid jet when filling the inner housing with the fluid, the impact portion comprising a base, a top and at least one deflection wall converging from the base to the top, the impact portion being positioned at a longitudinal end of the core along the longitudinal axis, wherein an outermost surface in the longitudinal axis of the impact portion is rounded and the slope of the at least one deflection wall in at least one plane normal to the base and passing through the top has several values, wherein the impact portion faces a fluid inlet of the inner housing; and wherein an entirety of a portion of the core forming the aeronautical part is not in direct contact with the mold.

2. The core according to claim 1, wherein the impact portion extends continuously from the body.

3. The core according to claim 1, wherein the slope of the at least one deflection wall is lower in the vicinity of the top than the slope in the vicinity of a base of the impact portion.

4. The core according to claim 3, wherein the impact portion and the body are connected at least by a plurality of shanks.

5. The core according to claim 1, wherein the impact portion has a height comprised between 100% and 1,000% of the width of the core.

6. The core according to claim 5, wherein the impact portion and the body are connected at least by a plurality of shanks.

7. The core according to claim 1, wherein the body and the impact portion are formed integrally.

8. The core according to claim 1, wherein the impact portion and the body are connected at least by a plurality of shanks.

9. The core according to claim 1, wherein the impact portion has a height of between 100% and 1,000% of the width of the core, and the impact portion and the body are connected at least by a plurality of shanks.

10. The core according to claim 1, wherein the core is disposed in the inner housing defined by the mold, wherein the body forms the internal shape of the aeronautical part, and wherein, according to all the planes normal to the base and passing through the top, the slope of the deflection wall has several values, decreasing as they approach the top, wherein the tangent to the deflection wall in the vicinity of the base is vertical, and wherein, in the vicinity of the top, the tangent to the deflection wall is horizontal.

11. The core according to claim 1, wherein the body forms the internal shape of the aeronautical part.

12. A foundry device for a turbine blade, comprising:

a mold defining an inner housing, the inner housing comprising a fluid inlet;

a core according to claim 1, disposed inside the inner housing.

13. A method for producing the core according to claim 1 the method for producing the core comprising the following steps:

designing a core pattern comprising the provision of the body of the core, whose geometry corresponds to the internal shape of the aeronautical part, and the generation of an impact portion, and manufacturing the core based on the pattern.

14. The method according to claim 13, wherein the step of generating the impact portion comprises an extrusion sub-step consisting of forming a prism from the body, the prism extending from the base, and a sub-step of cutting the prism.

15. The method according to claim 14, wherein, the step of generating the impact portion further comprises a sub-step of radiating the sharp edges after the sub-step of cutting the prism.

16. The method according to claim 13, wherein the step of generating the impact portion is carried out by Computer-Aided Design software.

* * * * *